US007191854B2

(12) United States Patent
Lenkman

(10) Patent No.: US 7,191,854 B2
(45) Date of Patent: Mar. 20, 2007

(54) SELF PROPELLED GURNEY AND RELATED STRUCTURE CONFIDENTIAL AND PROPRIETARY DOCUMENT

(76) Inventor: Thomas E. Lenkman, TLD Concepts, 83 Jason Ct., St. Charles, MO (US) 63304

( * ) Notice: Subject to any disclaimer, the term of this patent is extended or adjusted under 35 U.S.C. 154(b) by 190 days.

(21) Appl. No.: 10/735,779

(22) Filed: Dec. 16, 2003

(65) Prior Publication Data

US 2005/0126835 A1 Jun. 16, 2005

(51) Int. Cl.
*A61G 5/04* (2006.01)

(52) U.S. Cl. ..... 180/65.1; 180/19.1; 280/43.17; 5/600; 5/86.1

(58) Field of Classification Search ..... 280/43.17, 280/47.11; 180/65.1, 19.1, 19.2, 19.3, 15; 5/86.1, 600
See application file for complete search history.

(56) References Cited

U.S. PATENT DOCUMENTS 3,380,546 A * 4/1968 Rabjohn ..... 180/65.1
5,083,625 A * 1/1992 Bleicher ..... 180/65.1
5,348,326 A * 9/1994 Fullenkamp et al. .... 280/43.17
5,765,859 A * 6/1998 Nowell et al. ..... 280/86.5
5,772,237 A * 6/1998 Finch et al. ..... 180/65.1
5,806,111 A * 9/1998 Heimbrock et al. ..... 5/86.1
6,178,575 B1 * 1/2001 Harada ..... 5/600
6,286,165 B1 * 9/2001 Heimbrock et al. ..... 5/600
6,330,926 B1 * 12/2001 Heimbrock et al. ..... 180/65.5
6,390,213 B1 * 5/2002 Bleicher ..... 180/65.1
6,588,523 B2 * 7/2003 Heimbrock et al. ..... 180/65.5
6,598,247 B1 * 7/2003 Heimbrock et al. ..... 5/86.1
6,752,224 B2 * 6/2004 Hopper et al. ..... 180/22
6,772,850 B1 * 8/2004 Waters et al. ..... 180/65.5
6,792,630 B1 * 9/2004 Palmatier et al. ..... 5/86.1
6,877,572 B2 * 4/2005 Vogel et al. ..... 180/15
6,902,019 B2 * 6/2005 Heimbrock et al. ..... 180/65.5

* cited by examiner

*Primary Examiner*—Jeff Restifo
(74) *Attorney, Agent, or Firm*—Grace J. Fishel

(57) ABSTRACT

A modular drive unit for a gurney including a control/handle module, a cord reel/charger module, a drive module, and a chassis assembly, plus all needed electrical wiring harnesses and pneumatic tubing to connect them. The modules mount to any existing gurney and to each other without making permanent modifications to the gurney. The gurney is controlled by a handle assembly containing all necessary controls and indicators to allow the operator to select forward or reverse direction, increase or reduce speed of travel, observe the state of battery charge, and energize or deenergize power from the various modules. In addition, the handle may be swung down through 180 degrees to facilitate loading and unloading the gurney.

21 Claims, 10 Drawing Sheets

SELF PROPELLED GURNEY AND RELATED STRUCTURE CONFIDENTIAL AND PROPRIETARY DOCUMENT

I FIELD OF THE INVENTION

This invention relates to self-propelled hospital equipment, specifically gurneys.

II BACKGROUND OF THE INVENTION

Modular hospital gurneys are large, heavy pieces of equipment having a plurality of free castering wheels. When occupied by a patient, a gurney becomes extremely heavy and cumbersome to control, particularly on slanted or uneven surfaces. Directional control of gurneys has been improved in the past by the introduction of a small, unpowered, non-castering wheel in the center of the unit. This reduces the tendency of the gurney to move in random directions due to its castering wheels. However, the gurney is still large and very heavy when occupied, necessitating its operation by two or more people. Even so, there is still a risk of back or other personal injury on the part of the operators.

Motorizing the gurney allows it to be easily handled by one person, and dramatically reduces the risk of personal injury on the part of the operator. Other motorized gurneys are in use, but they are purpose-built as powered units, which increases the cost. The present invention comprises modular units which can easily be mounted on any existing gurney, motorizing it.

U.S. Patent Application 20020043411 discloses a stretcher having a motorized wheel. This invention comprises a purpose-built gurney with an integral motor drive unit.

U.S. Patent Application 20030024048 discloses a patient-support apparatus having grippable handle. This invention is similar to that disclosed in U.S. Patent Application 20020043411, but lacking a motor drive unit.

III SUMMARY OF THE INVENTION

A. Objects of the Invention

One object of the present invention is to provide a modular apparatus for converting a common hospital gurney to a self-propelled unit.

Another object of the present invention is to provide modular units which will easily and quickly mount to any gurney without need of modifying said gurney.

Another object of the present invention is to provide modular units which can be transferred to another gurney with a minimum of effort.

B. Summary

The present invention comprises a series of modules, including a control/handle module, a cord reel/charger module, a drive module, and a chassis assembly, plus all needed electrical wiring harnesses and pneumatic tubing to connect them. Also included are means to mount the modules to any existing gurney and to each other without making permanent modifications to the gurney. The gurney is controlled by a handle assembly containing all necessary controls and indicators to allow the operator to select forward or reverse direction, increase or reduce speed of travel, observe the state of battery charge, and energize or deenergize power from the various modules. In addition, the handle may be swung down through 180 degrees to facilitate loading and unloading the gurney.

Rechargable batteries of sufficient voltage are contained within the chassis assembly of the present invention. They provide all electrical power, and may be recharged using a self-contained charger assembly by means of a retractable AC power cord.

A small, internally driven wheel provides the means to move the gurney. The wheel is part of a drive unit which swivels up when electrical power is removed, allowing the gurney to be moved manually.

When power is applied, the drive unit swivels down by means of a pneumatically actuated air spring that provides sufficient pressure on the floor to afford traction to the drive wheel. The drive unit also compensates for irregularities in the floor surface, such as a ramp, by increasing the air pressure in the air spring and forcing the drive unit farther down.

IV THE DRAWINGS

V DESCRIPTION OF PREFERRED EMBODIMENTS

Figure 1:
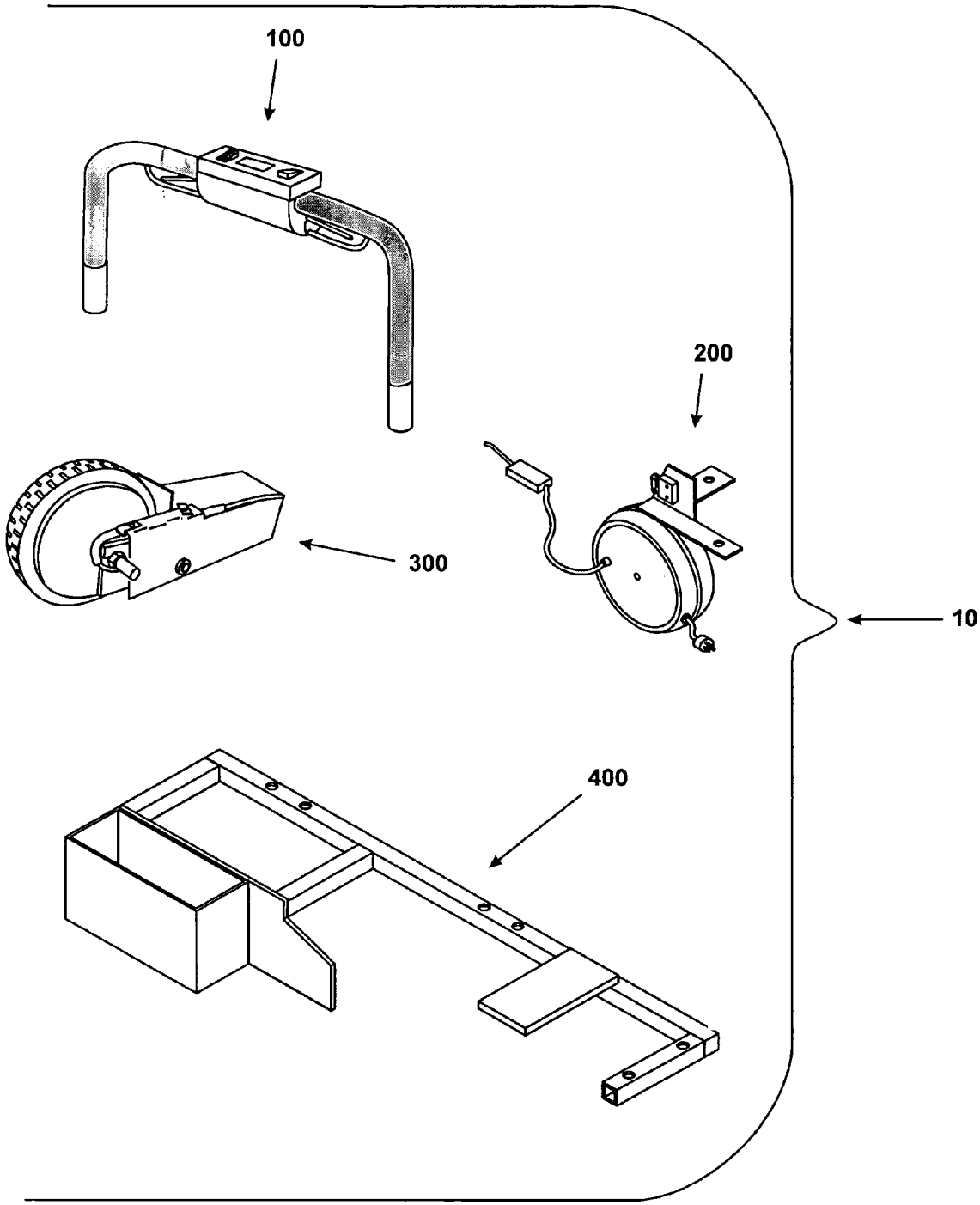
FIG. 1 is an exploded perspective view showing modules of the present invention.

In accordance with the present invention, FIG. 1 shows the present invention generally at 10, which comprises control/handle module 100, cord reel/charger module 200, drive module 300, and chassis assembly 400.

Figure 2:
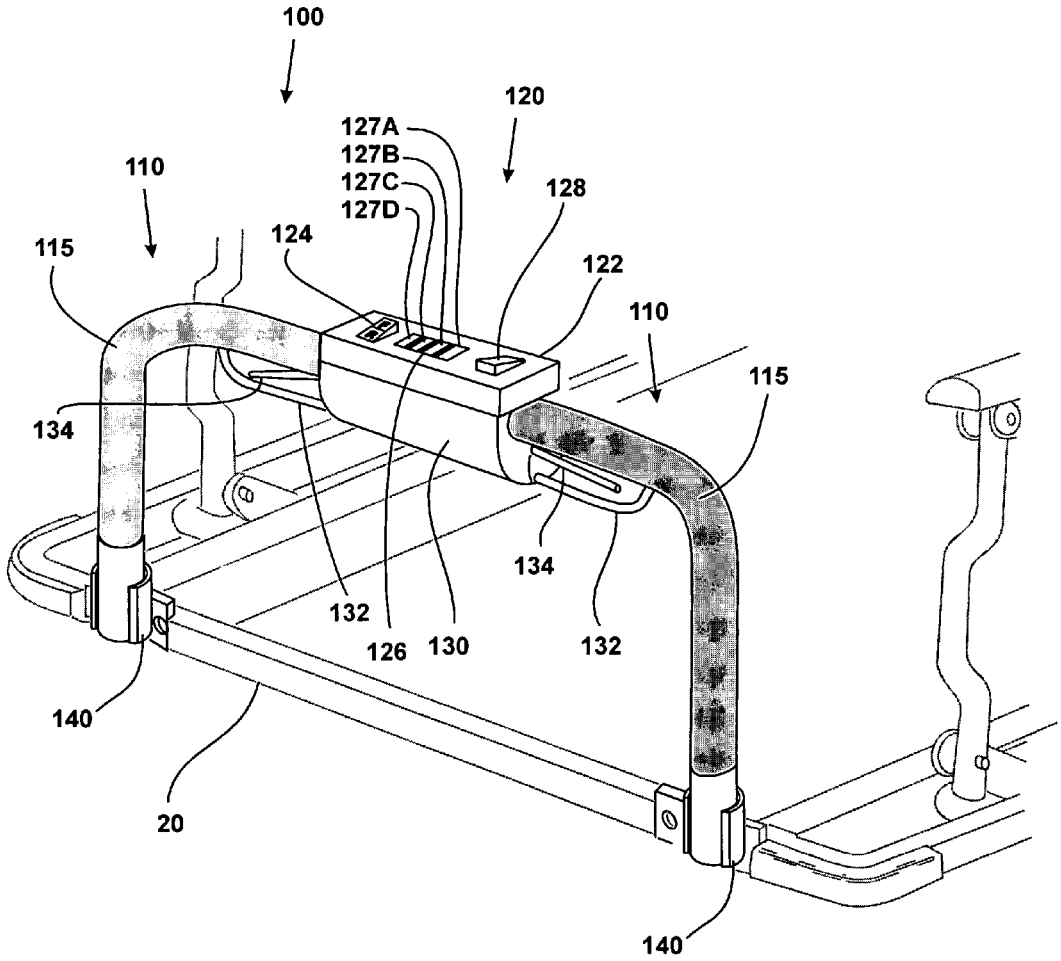
FIG. 2 is a perspective view of the control/handle module of the present invention, showing it mounted on a gurney in the normal position.

FIG. 2 shows control/handle module 100 in the normal position, mounted to a gurney 20 using mounting means 140. Handles 110 are made of steel, aluminum, carbon fiber, or other suitable material. Handles 110 are covered with a rubberized elastomeric substance 115, such as providing a non-slip grip for the operator.

Control assembly 120 is mounted to handles 110, is made of steel, aluminum, plastic or other suitable material, and comprises upper housing 122 and lower housing 130. Upper housing 122 contains directional switch 124, battery charge indicator 126, and on/off switch 128. Lower housing 130 contains throttle levers 134 and guards 132.

Figure 3:
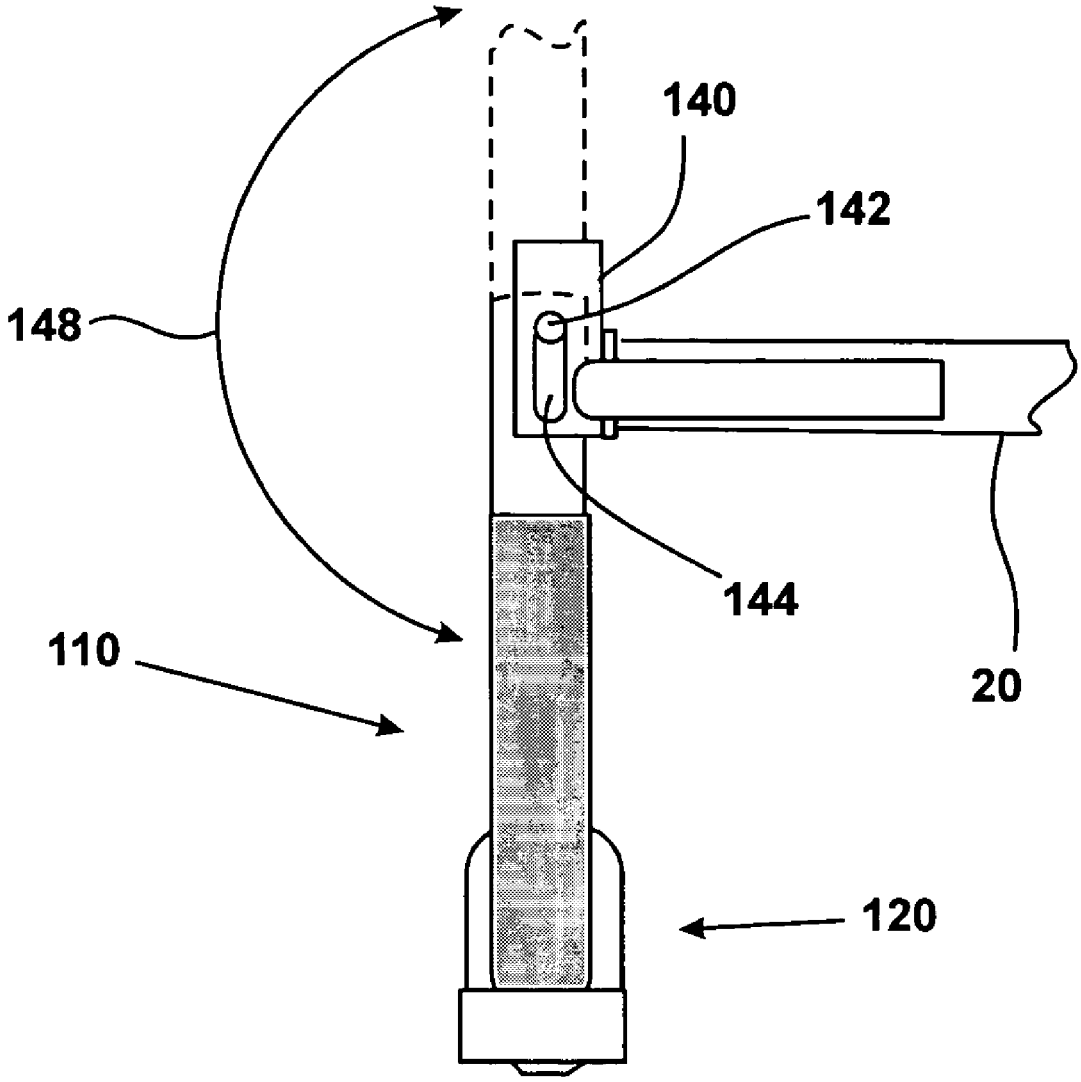
FIG. 3 is a side view of the control/handle module of the present invention, showing it in the folded down position.

FIG. 3 shows handles 110 in their down position. This position is provided to easily load or unload a patient from gurney 20. To move to the down position, the operator lifts straight up on handles 110, causing pivot 142 to move up in slot 144. This frees handles 110 from mounting means 140, and permits swinging it down through 180 degree angle 148.

Figure 4:
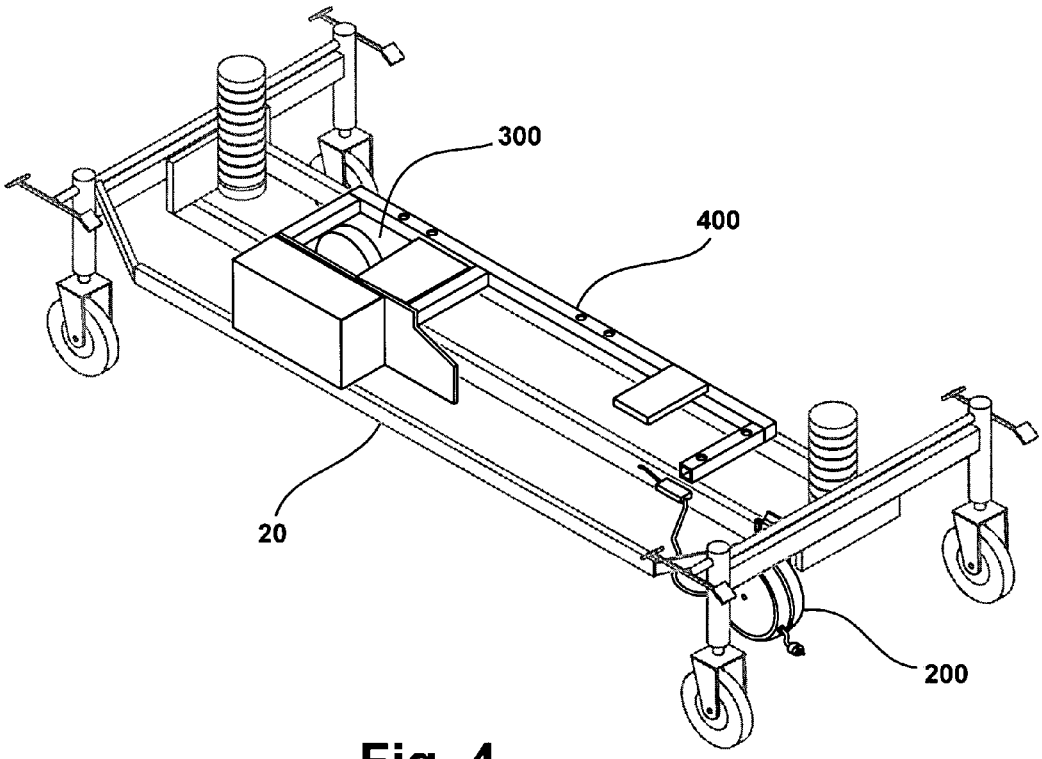
FIG. 4 is a perspective view showing the remaining modules of the present invention installed in a gurney.

FIG. 4 shows additional modules of the present invention (cord reel/charger module 200, drive module 300, and chassis assembly 400) mounted to a generic gurney 20 chassis. The bed portion of the gurney is not shown for clarity.

Figures 5A, 5B:
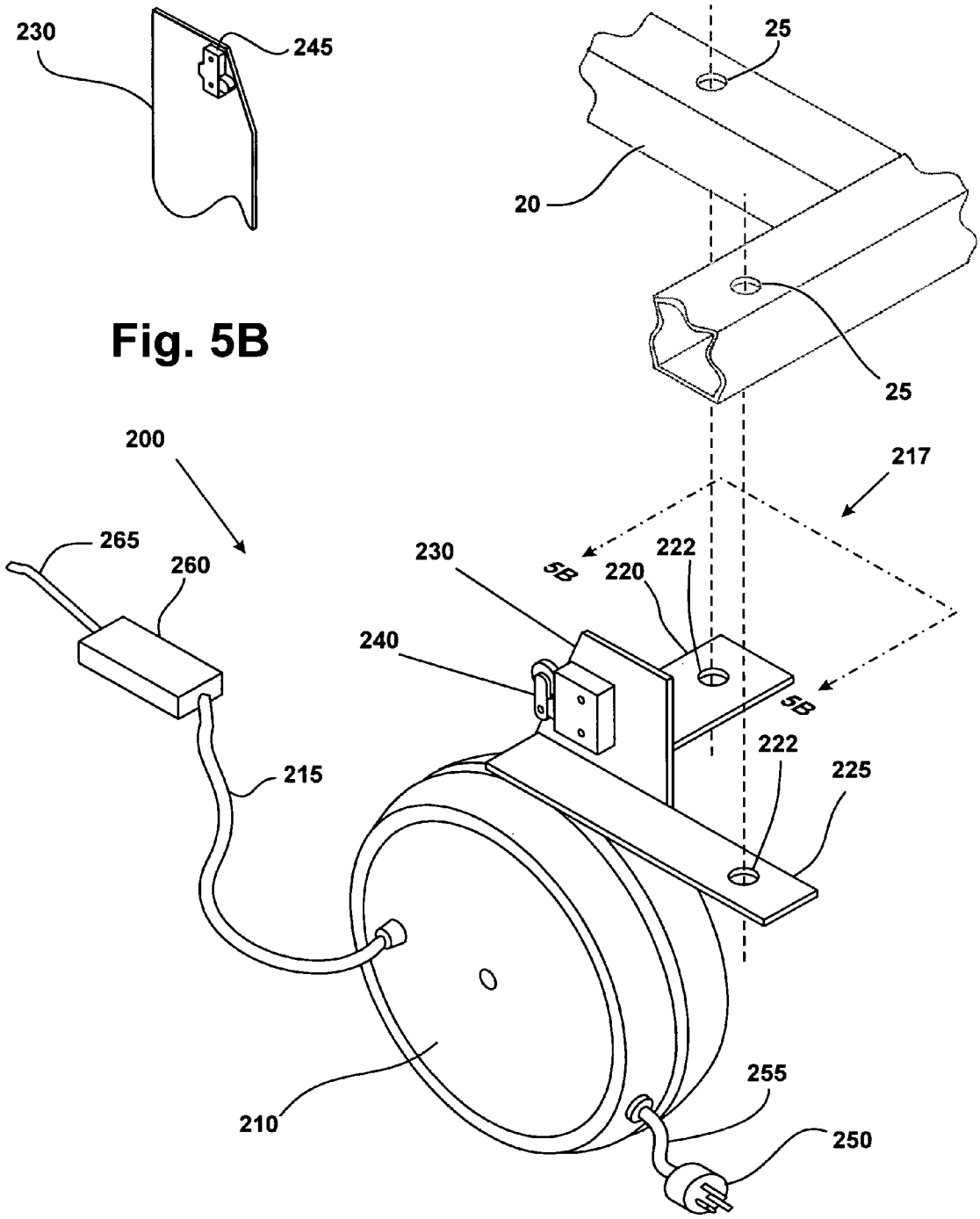
FIG. 5A is a perspective view of the cord reel/charger module of the present invention.
FIG. 5B is a perspective detail view of the cord reel/charger module of the present invention from the opposite side, looking in the direction of arrows 5B—5B in FIG. 5A.
Figure 7:
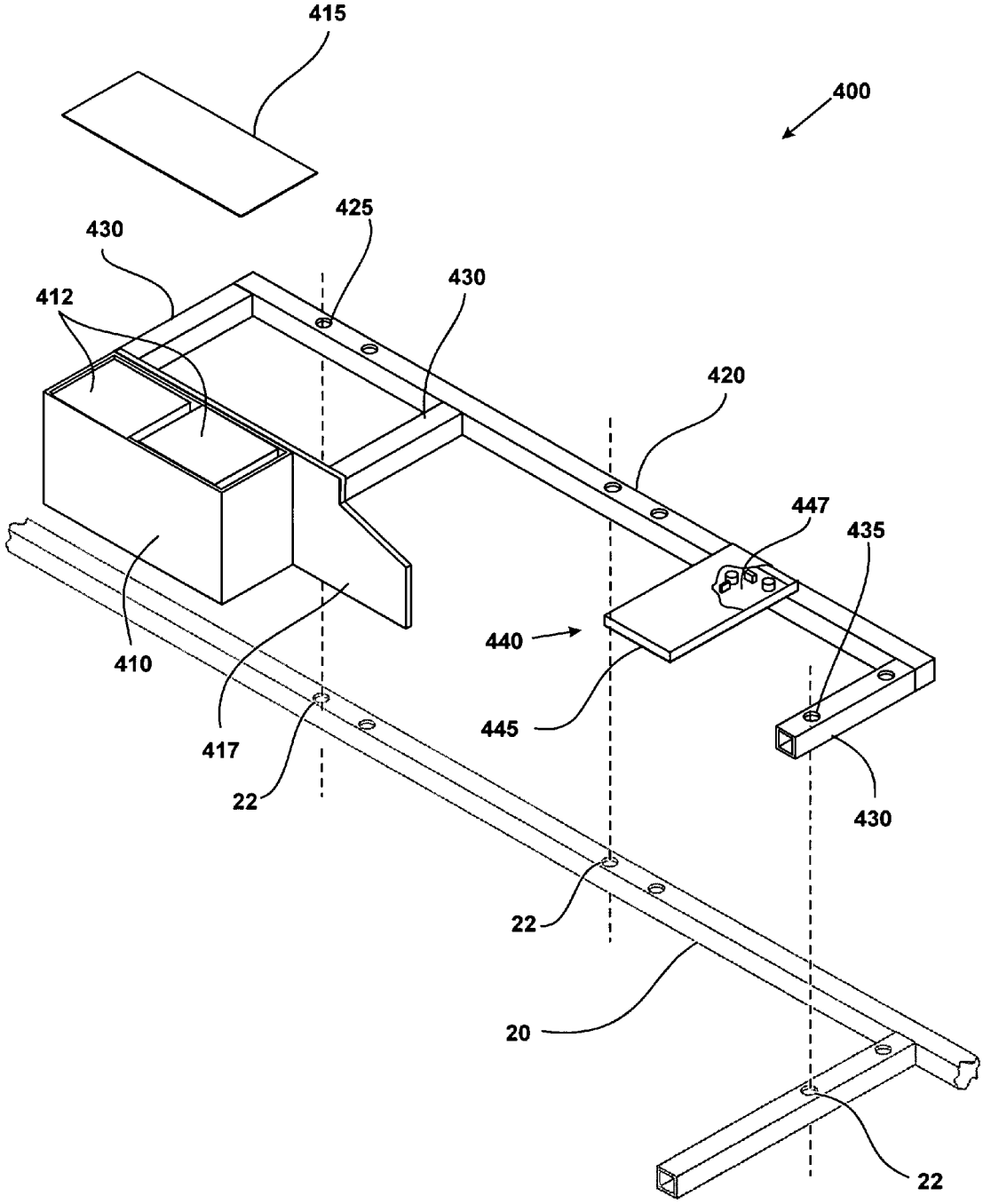
FIG. 7 is a partially exploded perspective view of the chassis of the present invention.

FIG. 5A shows cord reel/charger module 200. A commercially available retractable cord reel comprises reel enclosure 210, cord 215, cord 255, and plug 250. Cord 215 is connected to charger 260, a commercially available unit which may be manufactured by Chargetek, or other suitable vendor. Cord 265 is routed to batteries 412 (FIG. 7). Reel enclosure 210 is mounted to reel mount 217, which is made of steel, aluminum, carbon fiber, or other suitable material and comprises longitudinal support 225, lateral support 220, and switch bracket 230. Pneumatic interlock switch 240 is shown mounted to switch bracket 230. Cord reel/charger module 200 is mounted to existing holes 25 on gurney 20 using mounting holes 222.

In FIG. 5B, switch bracket 230 is shown from the opposite side, along with electric interlock switch 245.

Figure 6:
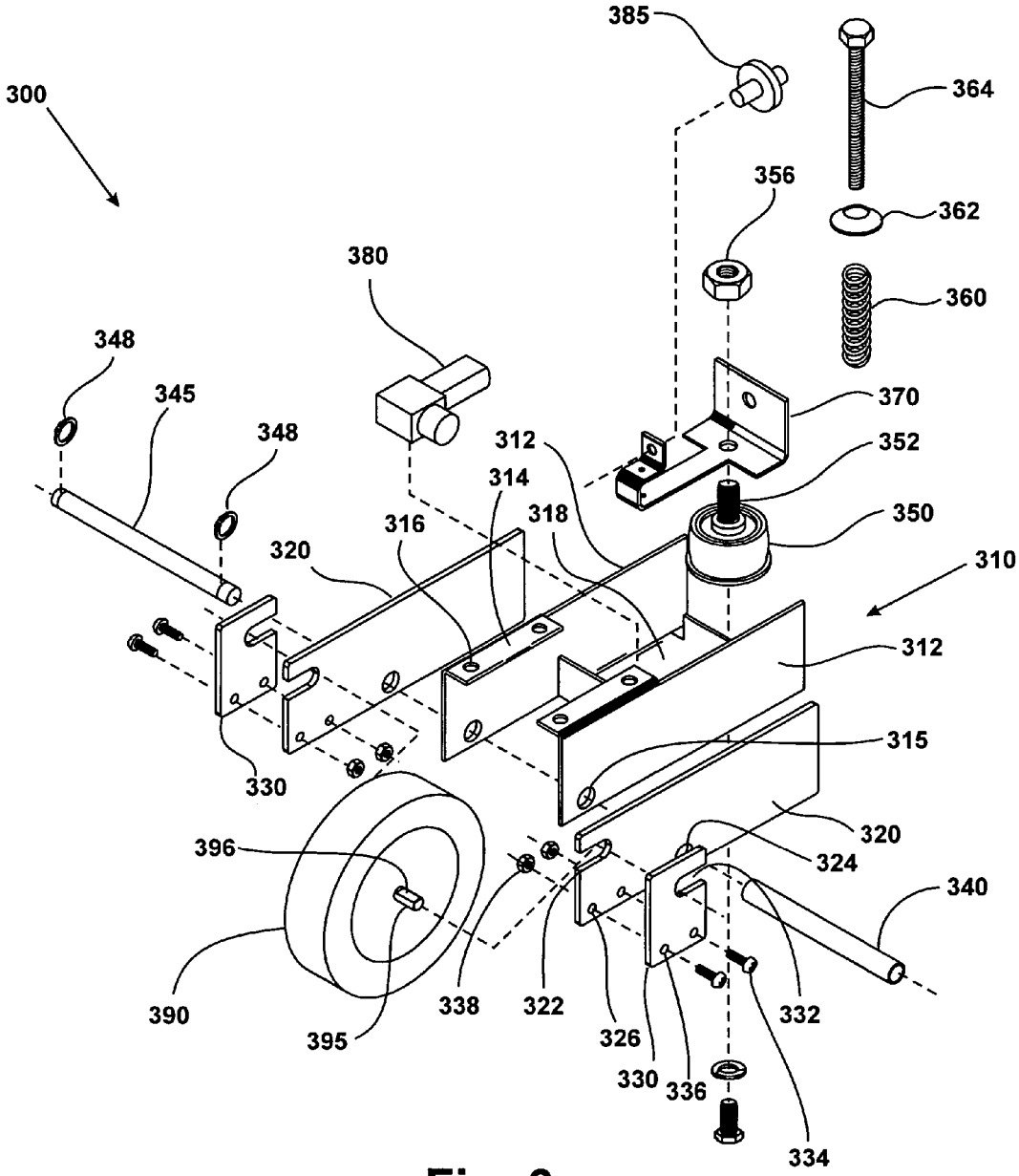
FIG. 6 is an exploded view of the drive module of the present invention.

FIG. 6 shows an exploded view of drive module 300. Drive housing 310 is made of steel, aluminum, carbon fiber, or other suitable material and comprises sides 312, mounting flanges 314, and bottom 318. All components of drive module 300 mount to drive housing 310, which in turn is mounted to gurney 20 via mounting holes 316. Pivot arms 320 are attached to drive housing 310 via spacer 340 and pivot axle 345 passing through pivot arm shaft holes 315 and 324. These assemblies are secured by spring clips 348.

Drive wheel 390 is manufactured by Assembled Products under the trade name of Hubmotor. Drive wheel 390 comprises a motor, a gear drive, and a solid rubber tire, negating the need for external components. Any other similar drive wheel meeting the requirements of the present invention may be used. Axles 395 of drive wheel 390 have flats 396, and fit into slots 322 of pivot arms 320. Lock plates 330 are mounted on pivot arms 320 via holes 326 and 336 by screws 334 and nuts 338. The flat sides of slots 322 and 332 fit the flats 396 of drive wheel 390 axles 395, preventing axles 395 from turning.

Air spring 350 is manufactured by Enidine or any suitable vendor, and is mounted to upper plate 370 by means of air spring inlet 352 and nut 356, and to drive housing 310 by means of bolt 354 and washer 358. Air pressure switch 385 is also mounted to upper plate 370. Air pressure switch 385 controls when air compressor 380 is activated, and is used to control the air pressure present in air spring 350, and thus the extent of its travel. Air pressure switch 385 may be adjusted to provide optimum wheel traction. Coil spring 360 is mounted to drive housing 310 by means of screw 364 and cap 362.

Air compressor 380 is manufactured by Thomas or other suitable vendor and is mounted into drive housing 310.

FIG. 7 shows chassis assembly 400, which is made of steel, aluminum, carbon fiber, or other suitable material. Chassis assembly 400 comprises battery box 410, battery box cover 415, battery box support 417, longitudinal member 420, and lateral members 430. Battery box 410 holds two commercially available, rechargable, 12-volt batteries 412. Battery box cover 415 reduces the possibility of water or other contaminants entering battery box 410. Chassis assembly 400 is mounted directly to any gurney 20 by means of mounting holes 425, 435, which are positioned to correspond with existing holes 22 in gurney 20. This eliminates the need to drill mounting holes in gurney 20.

Chassis assembly 400 also comprises control circuit board assembly 440, comprising circuit board 447 and circuit board cover 445. Circuit board 447 is a commercially available device, which may be manufactured by Rosstron, for example.

Figure 8:
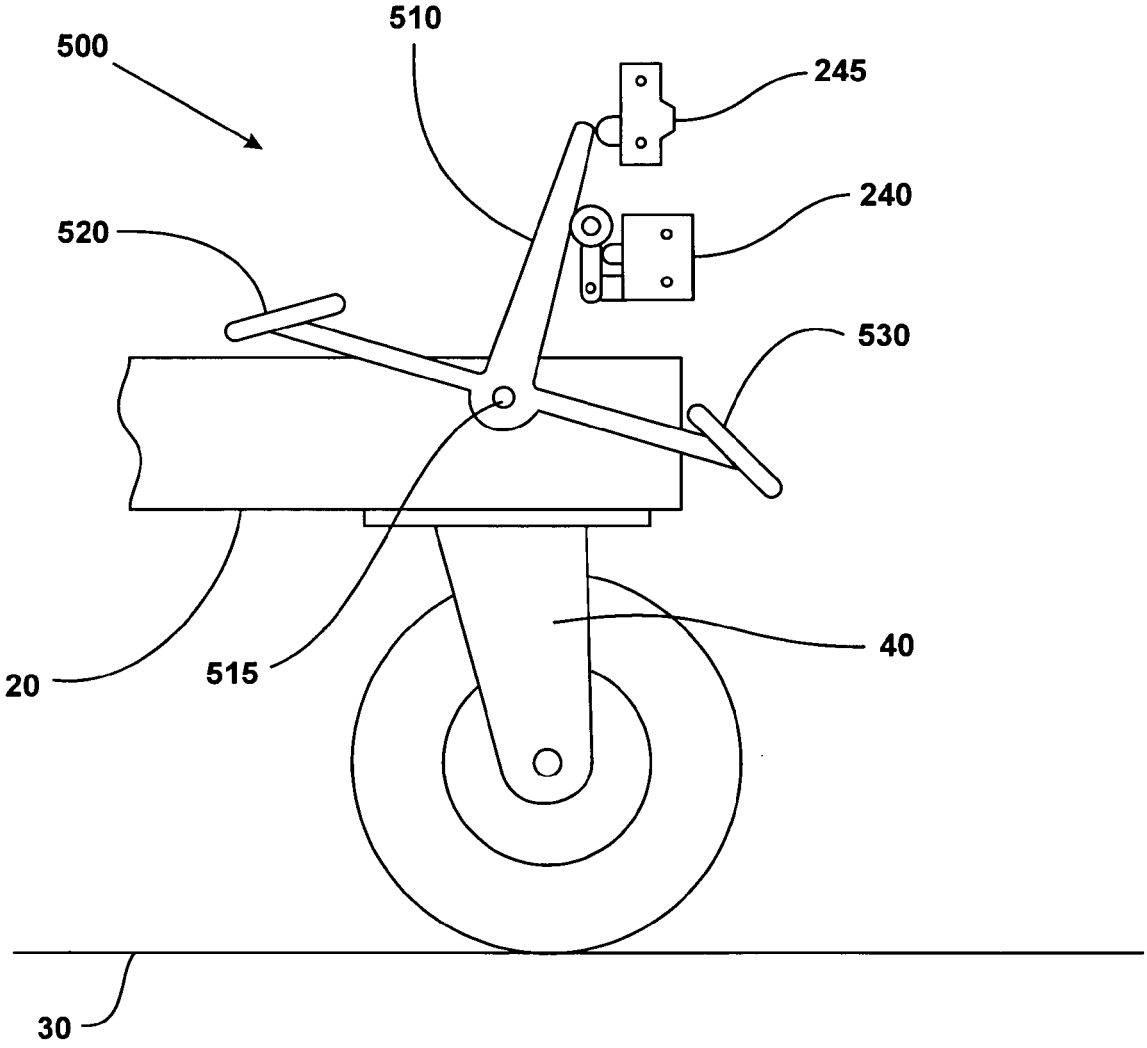
FIG. 8 is a side view of a gurney's brake pedal arrangement detailing how the electric and pneumatic switches are actuated.

FIG. 8 is a side view of how the existing foot controls 500 of gurney 20 interact with electrical and pneumatic circuitry of the present invention. The exact details of switch actuation may vary from one gurney design to another. Red brake pedal 520 and green release pedal 530 are mounted to actuator arm 510, which is mounted to gurney 20 by means of pivot axle 515. When depressed, green release pedal 530 allows free movement of caster/wheel assembly 40. In addition, actuator arm 510 contacts pneumatic interlock switch 240 and electric interlock switch 245, allowing pneumatic and electric power to be routed to their respective destinations. Conversely, depressing red brake pedal 520 locks caster/wheel assembly 40, while removing contact from pneumatic interlock switch 240 and electric interlock switch 245, removing pneumatic and electric power from their respective destinations.

Figure 9A:
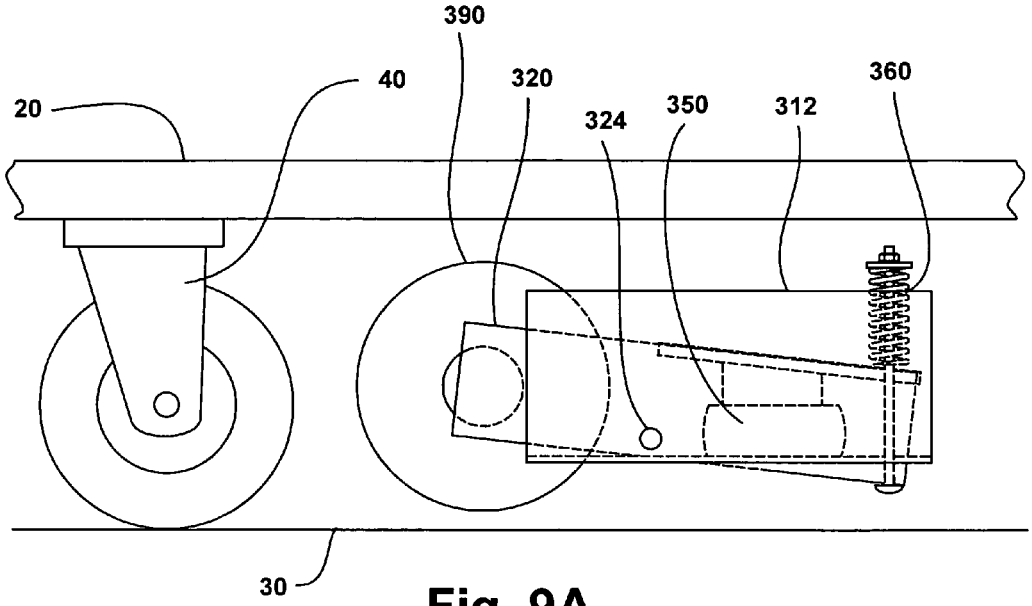
FIG. 9A is a side view showing the present invention in its retracted position.

FIG. 9A shows a side view of the present invention in its retracted position. Air spring 350 is deflated, allowing pivot arms 320 to swivel up around pivot arm shaft hole 324 due to pressure from coil spring 360. This lifts drive wheel 390 up from floor 30 and allows manual operation of gurney 20.

Figure 9B:
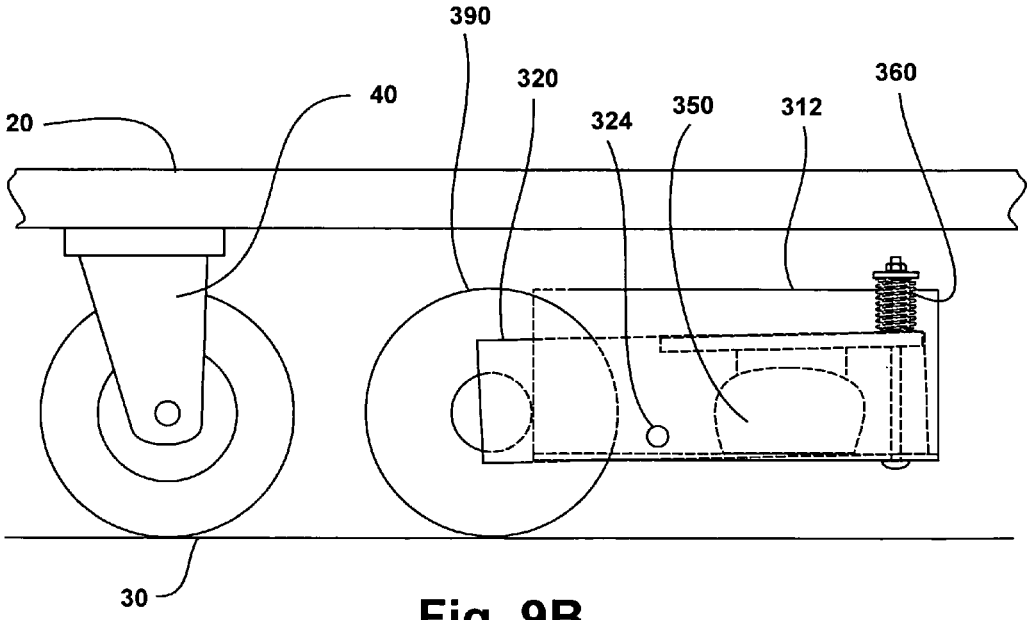
FIG. 9B is a side view showing the present invention in its engaged position on a normal floor surface.

FIG. 9B shows a side view of the present invention in its extended position. Air spring 350 is inflated, causing pivot arms 320 to swivel down around pivot arm shaft hole 324 against pressure from coil spring 360. This forces drive wheel 390 down against floor 30, permitting self-propelled operation of gurney 20.

Figure 10:
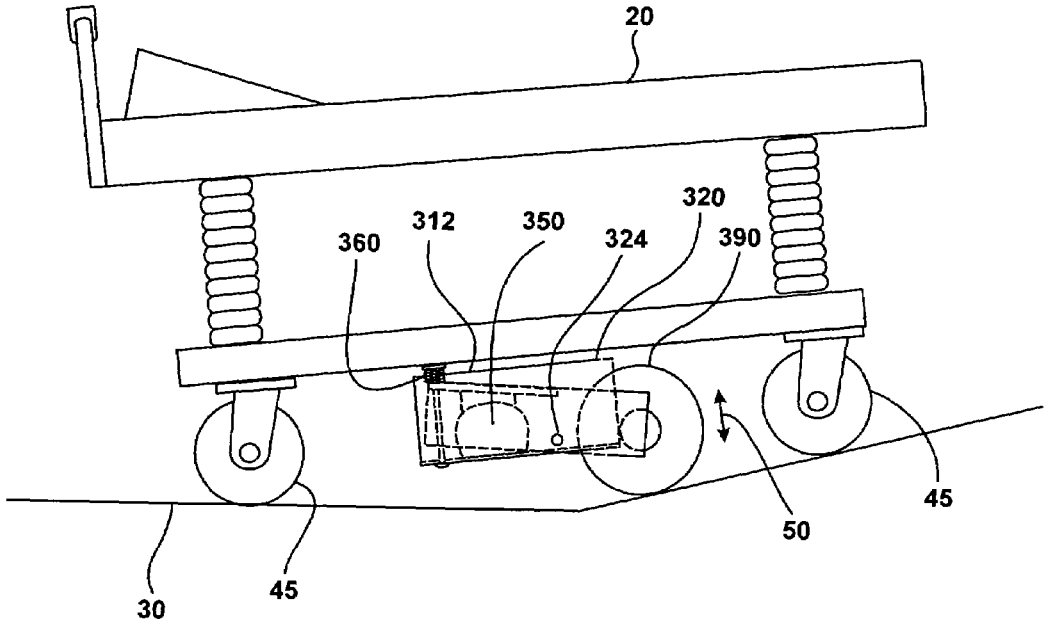
FIG. 10 is a side view showing the present invention in its engaged position on an irregular floor surface.

FIG. 10 shows shows a side view of the present invention in its extended position on a slanted floor 30. Air spring 350 inflates to a greater extent, causing pivot arms 320 to swivel farther down around pivot arm shaft hole 324 against pressure from coil spring 360. This forces drive wheel 390 down against floor 30, permitting self-propelled operation of gurney 20 on an uneven surface.

In the self-propelled mode, an operator first steps on green release pedal 530 (FIG. 8), releasing the brakes of gurney 20 and actuating pneumatic interlock switch 240 and electric interlock switch 245. Electric interlock switch 245 completes an electrical circuit, energizing the controls in control/handle module 100 (FIG. 2), as well as all other electrical circuitry. Pneumatic interlock switch 240 (FIG. 8) completes a pneumatic circuit, allowing compressor 380 (FIG. 6) to provide compressed air to air spring 350 via air pressure switch 385.

The operator turns on/off switch 128 (FIG. 2) to the ON position, energizing compressor 380 (FIG. 6) which provides compressed air to air spring 350 via air pressure switch 385. Drive wheel 390 is forced down against floor 30 as shown in FIG. 9B. When drive wheel 390 contacts floor 30 with sufficient force to provide motive power to gurney 20, air pressure switch 385 (FIG. 6) removes electrical power from compressor 380. The drive wheel is now in position for self-propelled operation.

The operator selects the desired direction of travel using direction switch 124 (FIG. 2). The operator squeezes one or both throttles 134, which provide variable electrical power to drive wheel 390 (FIG. 6) via control circuit board 447 (FIG. 7). Gurney 20 now moves under its own power, allowing the operator absolute control of its speed and direction of motion. If drive wheel 390 travels over a slanted floor, such as a ramp, as shown in FIG. 10, there is less pressure on air spring 350. Pressure switch 385 (FIG. 6) senses this reduced pressure, and energizes compressor 380, which supplies more air to air spring 350, keeping drive wheel 390 in contact with floor 30 (FIG. 10). If the level of floor 30 rises, causing more air pressure inside air spring 350 (FIG. 10), this condition is sensed by pressure switch 385 (FIG. 6), which releases the excess pressure. The net result is that drive wheel 390 exerts the same force on floor 30 regardless of its level relative to gurney 20.

Releasing throttles 134 (FIG. 2) de-energizes drive wheel 390 (FIG. 6), causing gurney 20 to stop. As long as drive wheel 390 is in contact with floor 30, gurney 20 is inhibited from moving, but will not be locked into place until the operator actuates red brake pedal 520 (FIG. 8). So doing sets the brakes on all wheel/caster assemblies 40 and removes electrical and pneumatic power from all components of the present invention. Once pneumatic pressure is removed from air spring 350, it deflates, allowing drive wheel 390 to raise up from floor 30 (FIG. 9A). At this point, the operator should turn on/off switch 128 (FIG. 2) to the OFF position. In the event the operator forgets to turn on/off switch 128 off, built-in circuitry removes all electrical power after a preset time delay. This reduces the possibility of discharging the batteries through neglect.

Battery charge indicator 126 (FIG. 2) comprises a series of lights 127A, 127B, 127C, 127D to indicate the state of the battery charge. The fewer lights lit, the more discharged are the batteries. To charge the batteries, the operator pulls plug 250 (FIG. 5A) from reel enclosure 210 and inserts it into any convenient wall receptacle. Charger 260 provides power to batteries 410 (FIG. 7) until they are fully charged.

What is claimed is:

1. A modular drive unit for propelling a gurney across a supporting surface comprising: a control/handle module, a cord charger module, a drive module, and a chassis assembly for mounting the drive module under a chassis of the gurney, said drive module comprising:

a drive wheel connected to an electric motor for rotating the wheel, said drive wheel mounted for rotation between pivot arms attached to the chassis assembly, said pivot arms resiliently biased by a spring such that the drive wheel is out of contact with the supporting surface, an air bag for selectively biasing the pivot arms against the resistance of the spring such that the drive wheel is in contact with the supporting surface, said air bag connected to an air compressor under control of an air pressure switch for controlling the air pressure in the air bag whereby the gurney is propelled across the supporting surface by the drive wheel when the drive wheel is in contact with the supporting surface.

2. A modular drive unit for a gurney according to claim 1 wherein said control/handle module provides means for maintaining directional and speed control over said gurney.

3. A modular drive unit for a gurney according to claim 2 wherein said control/handle module may be swung 180 degrees down from the operating position in order to facilitate loading or unloading said gurney.

4. A modular drive unit for a hospital gurney according to claim 2 wherein said control/handle module utilizes a coating on the handle to afford a non-slip grip for the operator.

5. A modular drive unit for a gurney according to claim 2 wherein at least one control/handle module contains all necessary means for a single operator to control a gurney's speed and direction of travel.

6. A modular drive unit for a gurney according to claim 1 wherein the cord charger module provides means to recharge batteries.

7. A modular drive unit for a gurney according to claim 6 wherein said cord charger module mainly comprises at least one cord reel.

8. A modular drive unit for a gurney according to claim 7 wherein said cord charger module contains mounting means to secure it to said gurney.

9. A modular drive unit for a gurney according to claim 6 wherein said cord charger module contains mounting means for interlock switches selected from hydraulic, electrical mechanical and pneumatic interlock switches which interact with standard linkages common to said gurney.

10. A modular drive unit for a gurney according to claim 9 wherein said interlock switches control the presence or absence of electrical power and air pressure to said modular unit.

11. A modular drive unit for a gurney according to claim 1 wherein said drive module comprises a drive wheel having a self-contained electric motor, gear, and tire unit which will move forward and reverse at variable speeds.

12. A modular drive unit for a gurney according to claim 11 wherein said air bag when selectively inflated forces said drive wheel in sufficient contact with the supporting surface to avoid slippage.

13. A modular drive unit for a gurney according to claim 11 wherein said air pressure switch maintains the inflation level of said air bag, irrespective of the relative distance between the support surface and the gurney chassis, causing said drive wheel to exert the same force on the floor.

14. A modular drive unit for a gurney according to claim 11 wherein said pivot arms of the drive module include a lock plate arrangement to adjustably capture an axle of said drive wheel in order to maintain its position relative to the rest of the drive module, and to prevent rotation of said axle.

15. A modular drive unit for a gurney according to claim 1 wherein the chassis assembly includes a battery box, a control circuit board assembly, and means to mount said drive module.

16. A modular drive unit for a gurney according to claim 15 wherein said chassis assembly is designed to mount to the frame of an existing gurney without modifying said gurney.

17. A modular drive unit for a gurney according to claim 15 wherein said battery box provides space for at least one rechargeable battery and contains a cover to reduce the possibility of water or other contaminants entering said battery box.

18. A modular drive unit for a gurney according to claim 15 wherein said control circuit board assembly provides an interface between said control/handle module and said drive module.

19. A modular drive unit for a gurney according to claim 1 containing an electrical wiring harnesses which provides all necessary electrical power and features quick-disconnect fasteners for ease of installation, maintenance, and battery replacement.

20. A modular drive unit for a gurney according to claim 1 containing pneumatic tubing which provide all necessary air pressure and feature quick-disconnect fasteners for ease of installation and maintenance.

21. A modular drive unit for a gurney according to claim 1 containing mounting means to attach the modules to each other and to the host gurney, said mounting means including but not be limited to: screws, bolts, nuts, washers, lock washers, and nylon tie wraps.

* * * * *